United States Patent [19]

Holdredge et al.

[11] Patent Number: 4,720,142

[45] Date of Patent: Jan. 19, 1988

[54] VARIABLE BACK STOP

[75] Inventors: Russell T. Holdredge; Glenn A. Knoblock, both of Kentwood; Charles P. Roossien, Wyoming, all of Mich.

[73] Assignee: Steelcase Inc., Grand Rapids, Mich.

[21] Appl. No.: 850,508

[22] Filed: Apr. 10, 1986

[51] Int. Cl.[4] ..... A47C 1/024

[52] U.S. Cl. ..... 297/300; 297/302; 297/306; 297/355

[58] Field of Search ..... 297/300, 301, 302, 303, 297/304, 305, 306, 354, 355, 377, 378, 270, 310

[56] References Cited

U.S. PATENT DOCUMENTS

| | | | |
|---|---|---|---|
| 217,584 | 7/1879 | Chichester . | |
| 362,796 | 5/1887 | Tait . | |
| 845,039 | 2/1907 | Leavitt | 297/355 X |
| 1,590,240 | 6/1926 | Gorton | 297/355 X |
| 1,663,898 | 3/1928 | Bitzenburger | 297/304 |
| 2,145,307 | 1/1939 | Hunt | 16/191 |
| 3,053,571 | 9/1962 | Fox | 297/300 |
| 3,371,959 | 3/1968 | Gordin | 297/310 |
| 3,379,473 | 4/1968 | Mizelle | 297/270 |
| 3,738,705 | 6/1973 | Hill | 297/354 X |
| 3,792,898 | 2/1974 | Lindbert | 297/355 |
| 3,822,917 | 7/1974 | George | 297/355 X |
| 3,826,532 | 7/1974 | Caldemeyer | 297/270 |
| 4,157,203 | 6/1979 | Ambasz | 297/300 |
| 4,248,479 | 2/1981 | Toda | 297/378 |
| 4,384,743 | 5/1983 | Barley | 297/355 |
| 4,494,795 | 1/1985 | Roossien et al. | 297/355 |

FOREIGN PATENT DOCUMENTS

| | | | |
|---|---|---|---|
| 1004127 | 1/1977 | Canada . | |
| 23575 | 9/1918 | Denmark | 297/300 |
| 1309132 | 11/1962 | France . | |
| 886608 | 1/1962 | United Kingdom | 297/354 |

OTHER PUBLICATIONS

Steelcase Chair Control P/N 4540861, Single Position Back Stop.

*Primary Examiner*—Kenneth J. Dorner
*Assistant Examiner*—Peter R. Brown
*Attorney, Agent, or Firm*—Price, Heneveld, Cooper, DeWitt & Litton

[57] ABSTRACT

A varible back stop is provided for tilt back chairs, and other similar seating, such as the type having a stationary support, and a back which tilts with respect to the support. The variable back stop comprises a stop surface, and at least one stop member, which are located on associated portions of the chair support and the chair back. The stop surface and the stop member are mutually positioned such that rearward tilting of the chair back generally converges the stop surface and the stop member along a line of motion, and forward tilting of the chair back generally diverges the same. The stop member has an engaged position wherein at least a portion of the stop member is positioned in the line of motion to abut the stop surface upon rearward tilting of the chair back, and a disengaged position, wherein the stop member is positioned outside of the path of motion to avoid abutting the stop surface upon rearward tilting of the chair back. An actuator shifts the stop member between the engaged and disengaged positions to selectively stop or limit rearward tilting of the chair back.

36 Claims, 37 Drawing Figures

2
4
6
99
1
3
13
10
11
12
30
29
22
21
20
23
25
64
28
119
125
87
86
26
27
85
6
40
46
5
41
50
44
53
15
16
24
33
32
17
18
19
7
14
31
35
34
36

FIG. 3
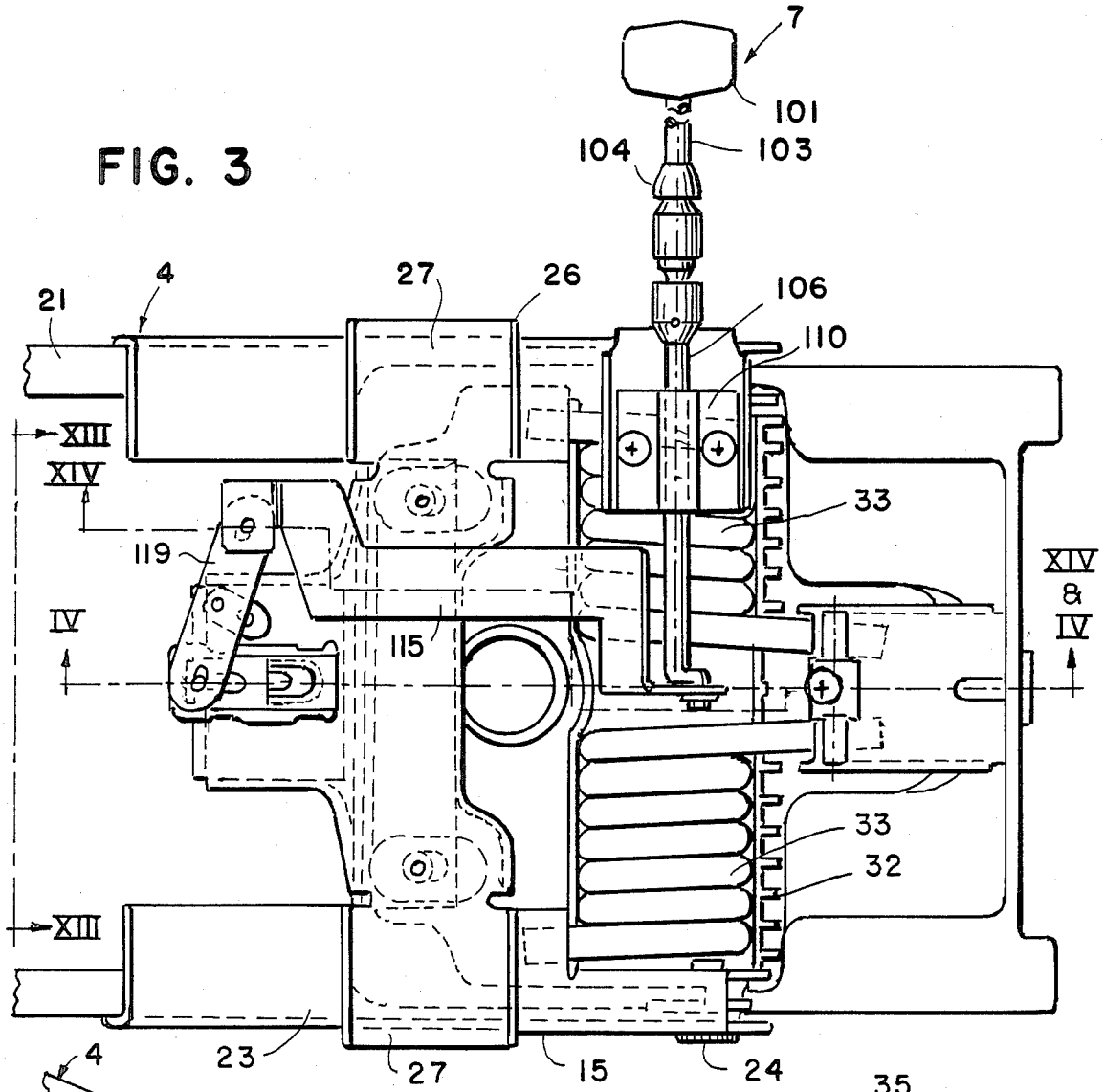
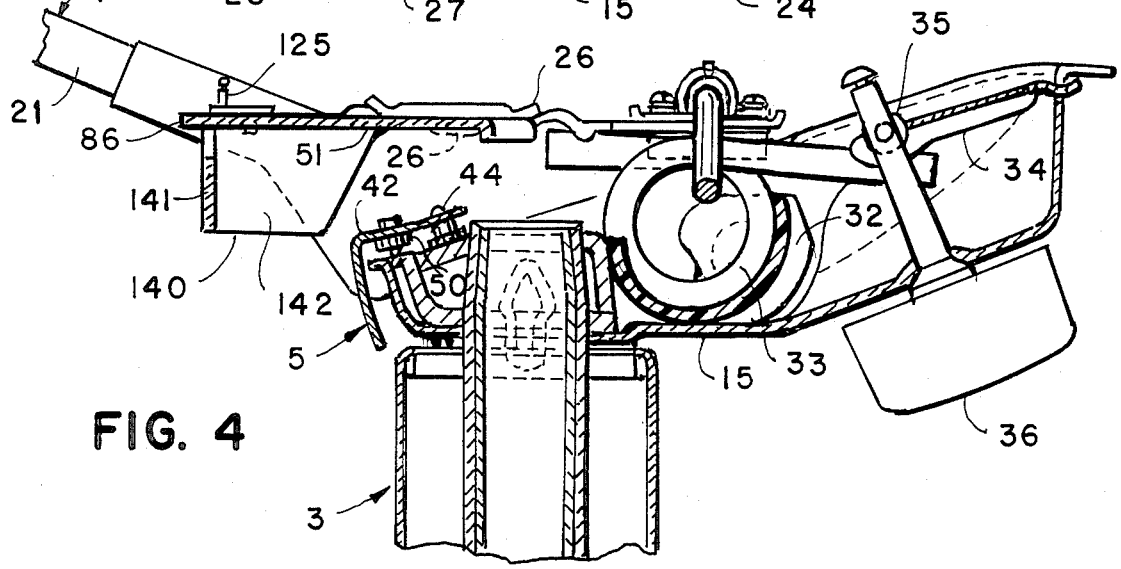
FIG. 4

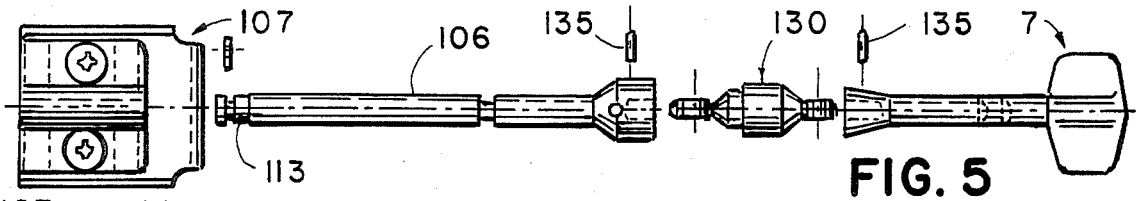
FIG. 5
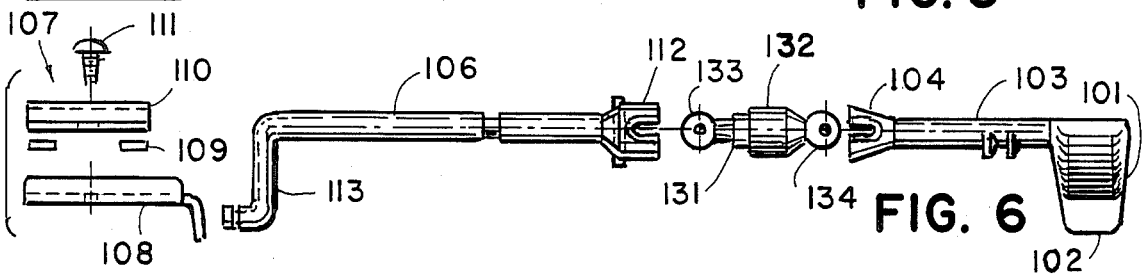
FIG. 6
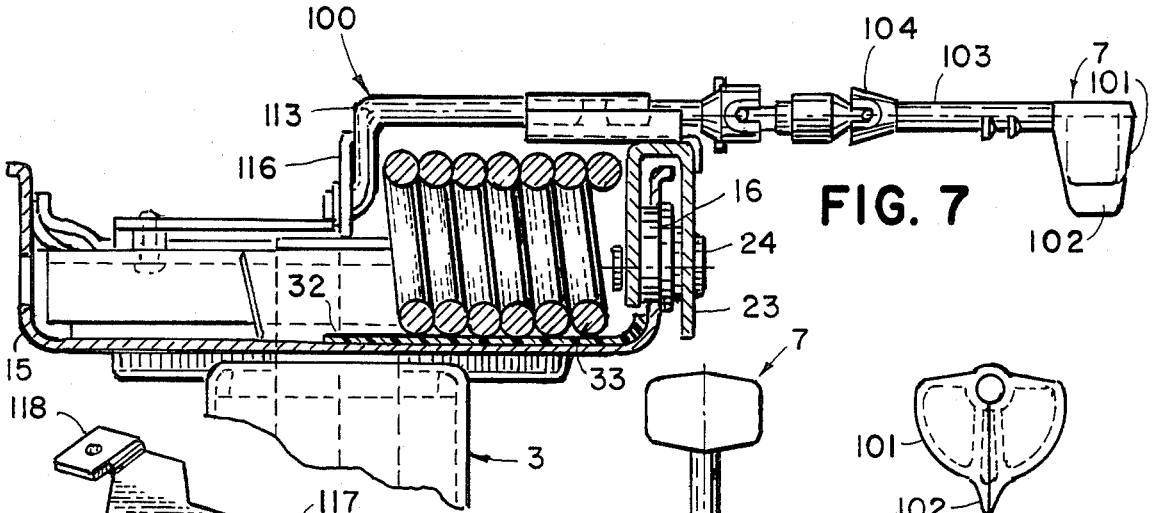
FIG. 7
FIG. 9
FIG. 8
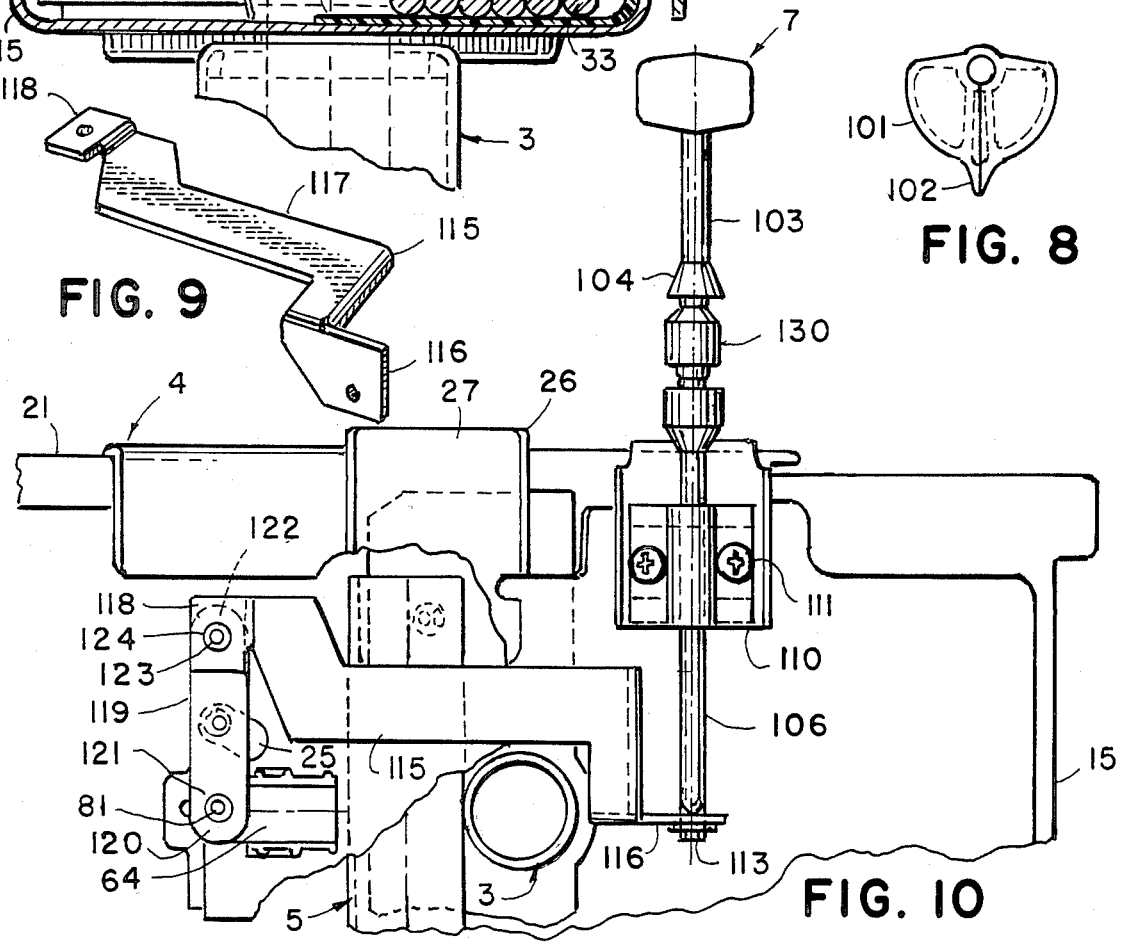
FIG. 10

VARIABLE BACK STOP

CROSS-REFERENCE TO RELATED APPLICATIONS

The present application is related to co-pending U.S. patent application Ser. No. 850,268, filed Apr. 10, 1986, entitled INTEGRATED CHAIR AND CONTROL, which is hereby incorporated by reference.

BACKGROUND OF THE INVENTION

The present invention relates to articulated furniture articles, and in particular to a variable back stop for seating, and the like.

Articulated seating, such as tilt back chairs, and other furniture articles of the type having at least two, mutually adjustable portions, are used extensively in office environments. The mutually adjustable portions of the seating are normally interconnected by a controller or control, which mechanically adjusts the mutual orientation of the various adjustable seating portions. Seating controls usually include springs which bias the seating into a normal or upright position. Such controls also typically include some type of adjustment device to vary the biasing force which resists movement of the adjustable portions of the seating from their normal position.

A stop assembly may be provided in articulated seating to selectively limit the amount of movement permitted between the mutually adjustable portions of the seating. For instance, in tilt back chairs, and other similar seating, a stop assembly may be used to limit the rearward tilting movement of the chair back. Because users have widely differing physical characteristics, including weight, shape, strength, and the like, and perform a variety of different seated tasks, the ultimate or most comfortable maximum tilt angle of the chair back varies from one individual to another. Also, the most comfortable back position will vary for any particular individual depending upon the task being performed. The variable back stop permits the chair to be adjusted to accommodate the particular individual, as well as the specific task with which the seating is used.

A type of seating known as "task seating" is becoming increasingly popular for use at computer terminals, and other similar work stations. Task seating is typically used by several different individuals on a regular basis, and must be readily adaptable for all types of applications and tasks. The ability to adjust the maximum rearward tilt position of a chair back is clearly a preferred feature in all types of articulating seating. However, in task seating, such adjustment capabilities are now considered to be an important factor in the overall marketability of the chair. It is particularly critical that adjustment of the maximum tilt position be capable of being made quickly and easily by the workers or users themselves. Preferably, such adjustment can be made by the user, while actually sitting on the chair, so that the maximum back tilt position can be made initially by a seated user, quickly tested, and easily readjusted if necessary, to attain maximum comfort. Furthermore, it is important that the maximum back tilt position be adjustable throughout a broad range, so as to be able to adapt the chair into a comfortable configuration for a wide variety of different persons and tasks.

SUMMARY OF THE INVENTION

One aspect of the present invention is to provide a positive, mechanical variable back stop for articulated seating, such as tilt back chairs, and the like, of the type having a stationary support and a back which tilts with respect to the support. The variable back stop comprises a stop surface, and at least one stop member, which are located on associated portions of the chair support and the chair back. The stop surface and the stop member are mutually positioned such that rearward tilting of the chair back generally converges the stop surface and stop member along a line of motion, and forward tilting of the chair back generally diverges the same. The stop member has an engaged position, wherein at least a portion of the stop member is positioned in the line of motion to abut the stop surface upon rearward tilting of the chair back, and a disengaged position, wherein the stop member is positioned outside of the path of motion to avoid abutting the stop surface upon rearward tilting of the chair back. An actuator shifts the stop member between the engaged and disengaged positions to selectively stop or limit rearward tilting of the chair back.

Preferably, a plurality of stop members are provided in a stacked arrangement to limit chair back tilt at a number of different positions, and an actuator is provided to manipulate the variable back stop from a seated position in the chair.

The principal objects of the present invention are to provide a mechanical, variable back stop that has a positive type of stopping action, and is extremely reliable. The stop is particularly adapted for controlling the rearward tilting action of a tilt back type of chair, and can be manipulated to limit chair back tilt at a wide variety of different positions to accommodate different persons and tasks. The variable back stop is designed to be easily adjusted from a seated position within the chair, so that the maximum back tilt position can be quickly tested and easily readjusted if necessary, to obtain maximum comfort. The variable back stop has a cushion arrangement that provides a gentle stopping action. Even while the variable back stop is set, it permits the control to bias the chair back to the fully upright position for improved user comfort and back support, particularly when exiting the chair. The variable back stop has a rather uncomplicated construction, is efficient in use, economical to manufacture, capable of a long operating life, and particularly adapted for the proposed use.

These and other features, advantages, and objects of the present invention will be further understood and appreciated by those skilled in the art by reference to the following written specification, claims, and appended drawings.

BRIEF DESCRIPTION OF THE DRAWINGS

FIG. 3 is a top plan view of a control portion of the chair.

FIG. 4 is a vertical cross-sectional view of the control, taken along the line IV—IV of FIG. 3.

FIG. 5 is an exploded, top plan view of an actuator portion of the variable back stop.

FIG. 6 is an exploded, side elevational view of the actuator.

FIG. 7 is a fragmentary, vertical cross-sectional view of the control.

FIG. 8 is a front elevational view of a toggle button portion of the actuator.

FIG. 9 is a perspective view of a control arm portion of the variable back stop.

FIG. 10 is is a fragmentary, top plan view of the variable back stop, with portions thereof broken away to reveal internal construction.

DETAILED DESCRIPTION OF THE PREFERRED EMBODIMENTS

Figures 1, 2:
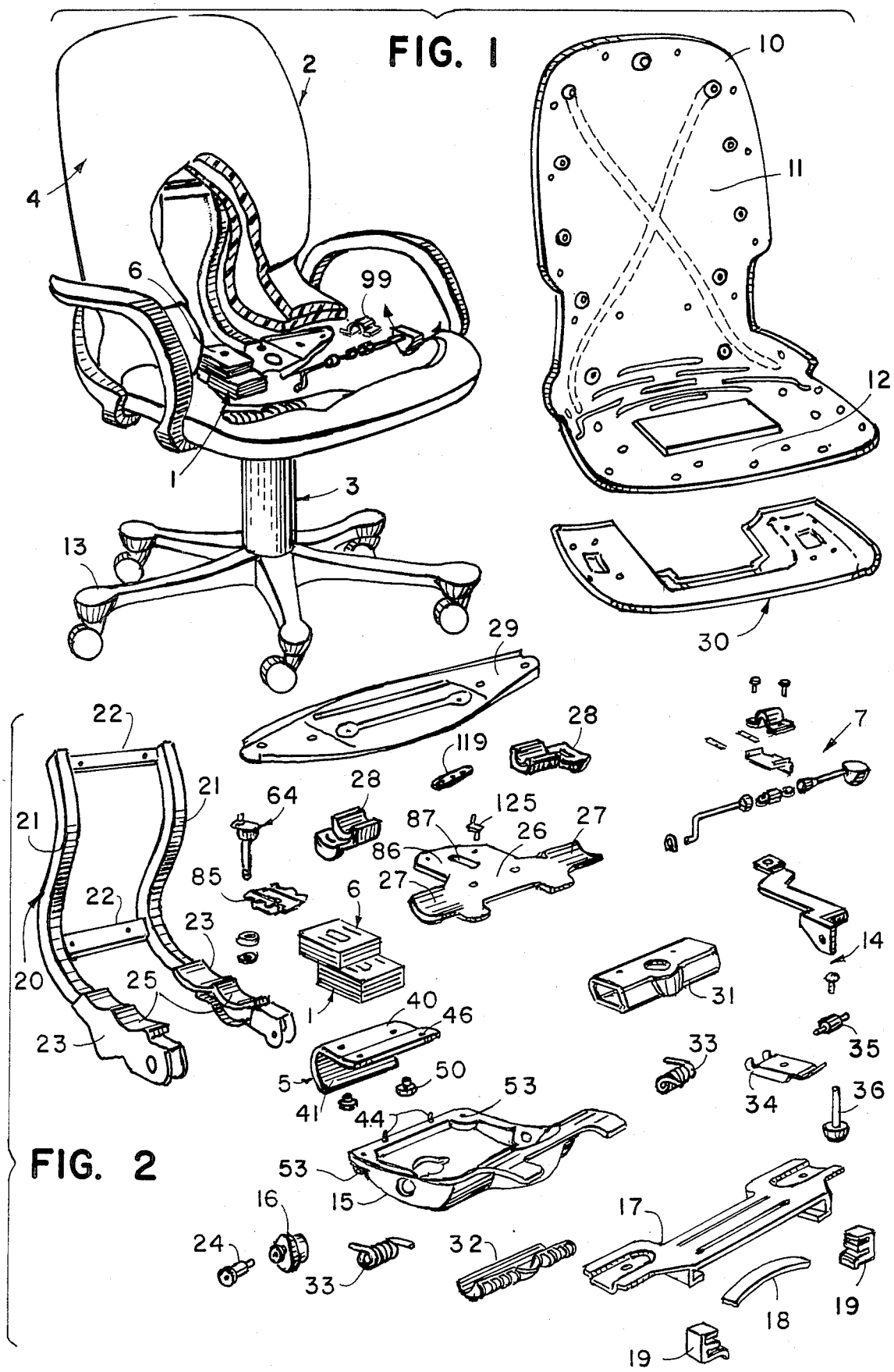
FIG. 1 is a perspective view of a chair, with portions thereof broken away to reveal a variable back stop embodying the present invention.
FIG. 2 is an exploded perspective view of the chair.
Figure 11:
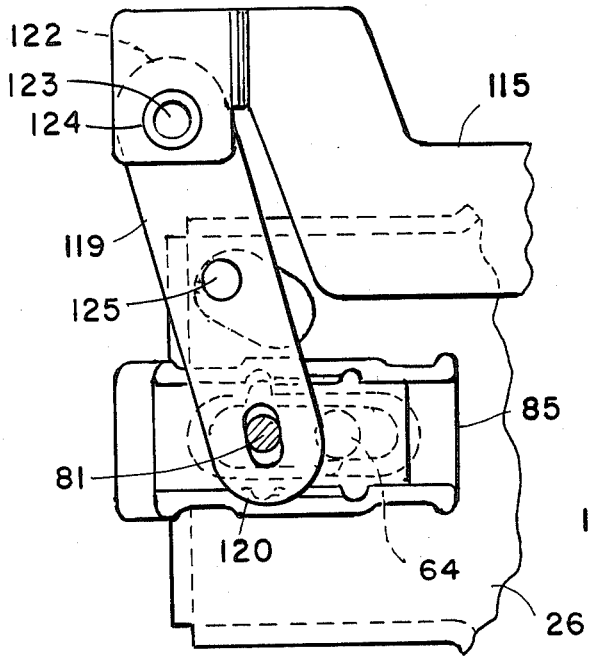
FIG. 11 is an enlarged, fragmentary, top plan view of the variable back stop, shown in an engaged position.
Figure 12:
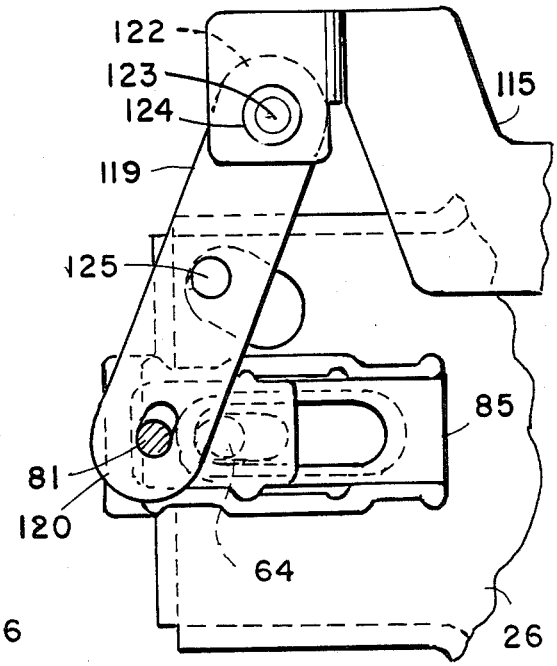
FIG. 12 is an enlarged, fragmentary, top plan view of the variable back stop, shown in a disengaged position.
Figure 13:
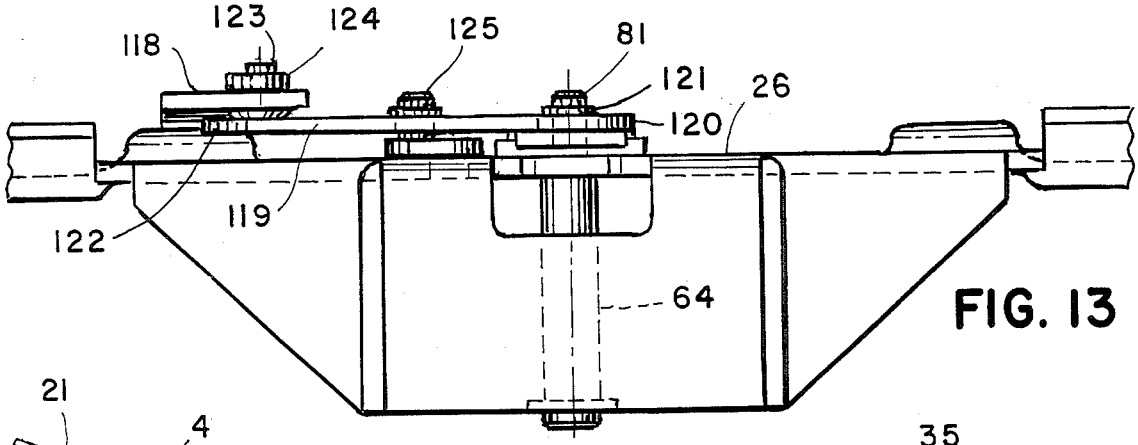
FIG. 13 is a rear elevational view of the variable back stop, taken along the line XIII—XIII of FIG. 3.
Figure 14:
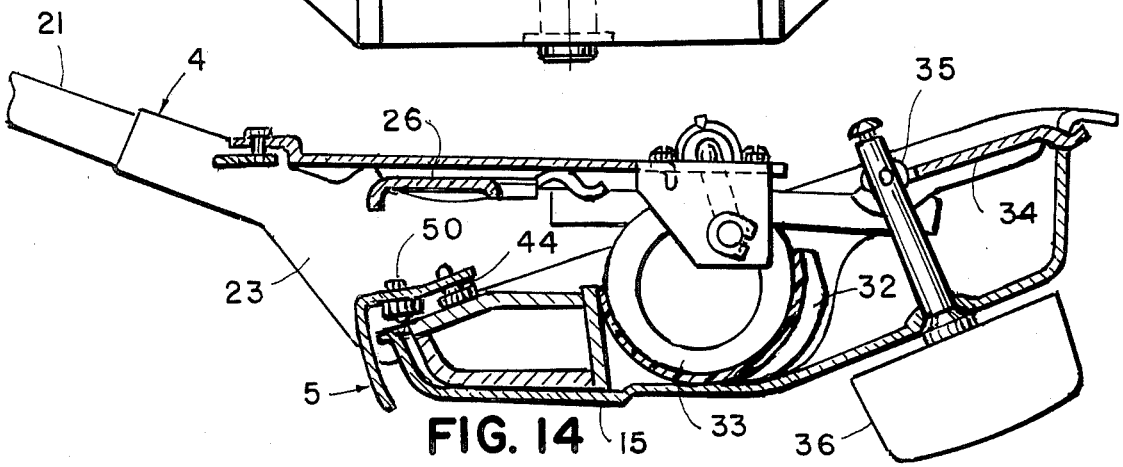
FIG. 14 is a vertical cross-sectional view of the control, taken along the line XIV—XIV of FIG. 3.
Figure 15:
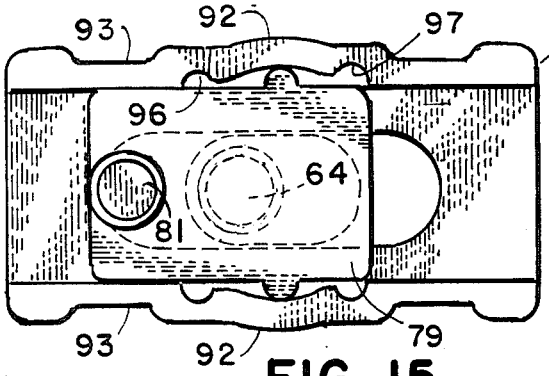
FIG. 15 is a top plan view of a stop plate assembly portion of the variable back stop.
Figure 16:
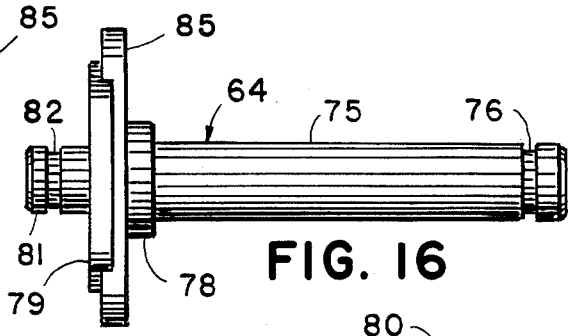
FIG. 16 is a side elevational view of the stop plate assembly.

For purposes of description herein, the terms "upper," "lower," "right," "left," "rear," "front," "vertical," "horizontal," and derivatives thereof shall relate to the invention as oriented in FIG. 1, and with respect to the seated user. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions, and other physical characteristics relating to the embodiments disclosed herein are not to be considered as limiting, unless the claims by their language, expressly state otherwise.

The reference numeral 1 (FIG. 1) generally designates a variable stop arrangement embodying the present invention. The illustrated variable stop 1 is shown mounted in a chair 2 of the type having a stationary support 3, and a back 4 which tilts with respect to support 3. Variable stop 1 is designed to stop or limit the rearward tilting motion of chair back 4, and thereby provide a variable back stop for chair 2.

The illustrated variable back stop 1 comprises a stop bracket 5 (FIG. 2) connected with chair support 3, and at least one stop member 6 connected with chair back 4. In the present example, stop member 6 comprises a plate shaped member, and a plurality of such stop plates 6 are provided in a stacked arrangement. It is to be understood that stop bracket 5 and stop plates 6 can be attached to opposite portions of chair 2, so long as mutual rotation of support 3 and back 4 causes the same to move with respect to one another. Stop bracket 5 and stop plates 6 are mutually positioned such that rearward tilting of chair back 4 generally converges stop bracket 5 and stop plates 6 along a line of motion, and forward tilting of chair back 4 generally diverges the same. Stop plates 6 have an engaged position (FIGS. 34–37), wherein at least a portion of the stop plates 6 are positioned in the line of motion to abut stop bracket 5 upon rearward tilting of chair back 4, and a disengaged position (FIGS. 32–33), wherein the stop plates 6 are positioned outside of the path of motion to avoid abutting stop bracket 5 upon rearward tilting of chair back 4. An actuator 7 (FIG. 2) shifts stop plates 6 between the engaged and disengaged positions to selectively stop or limit rearward tilting of chair back 4.

With reference to FIGS. 1 and 2, chair 2 has a unique construction, and is the subject of co-pending application Ser. No. 850,268, filed Apr. 10, 1986, and entitled INTEGRATED CHAIR AND CONTROL. The illustrated chair 2 includes a one-piece, molded shell 10 with a back rest or chair back 11 and a seat or chair bottom 12, a castered base 13, and a control 14 which connects shell 10 with base 13. Control 14 includes a formed metal housing 15, with bearing inserts 16 mounted in opposite sidewalls thereof. A front arm strap assembly 17, with leaf spring 18 and guides 19, is mounted on the forward portion of control housing 15, and slidably attaches the forward portion of seat bottom 11 to control 14. An upright assembly 20 is provided to support the back portion 11 of shell 10, and includes a pair of S-shaped uprights 21, two cross straps 22, and a pair of rear stretchers 23 mounted on the lower ends of uprights 21. Rear stretchers 23 have clevis-shaped bracket portions at their forward ends, which are received over the opposite sidewalls of control housing 15, and are rotatably mounted thereto by rivet axles 24 which extend through bearings 16.

Rear stretchers 23 have arcuately shaped support surfaces 25 on which a cross stretcher 26 is received and rigidly attached by means such as welding, or the like. Cross stretcher 26 has two, upwardly opening, arcuately-shaped bearing surfaces 27 on which mating bearing pads 28 are slidingly supported. Bearing pads 28 are mounted on a rear arm strap 29, which is in turn, connected with the rearward portion of seat bottom 12 to mount the same on control 14.

Control housing 15 includes a cross brace 31 fixedly mounted therein to reinforce control housing 15, and to form a socket in which base support 3 is received. A spring support 32 is mounted in control housing 15, and receives therein a pair of torsional coil springs 33. The rearward ends of coil springs 33 are received in the clevis bracket portions of rear stretchers 23, and the forward ends of coil springs 33 are engaged by an adjustor bracket 34, having its forward end pivotally mounted in the forward end of control housing 15. A transverse pin 35 is rotatably supported in the fork-shaped rearward portion of adjustor bracket 34, and includes a central threaded aperture in which an adjustor screw 36 is received. Coil springs 33 are tensioned by adjusting screw 36, and normally retain chair 2 in its fully upright position.

A bottom shell or cover assembly 30 is attached to chair bottom 12 on the lower side thereof, and is adapted to rotatably mount actuator 7 therein in the fashion described in greater detail hereinafter.

Figure 36:
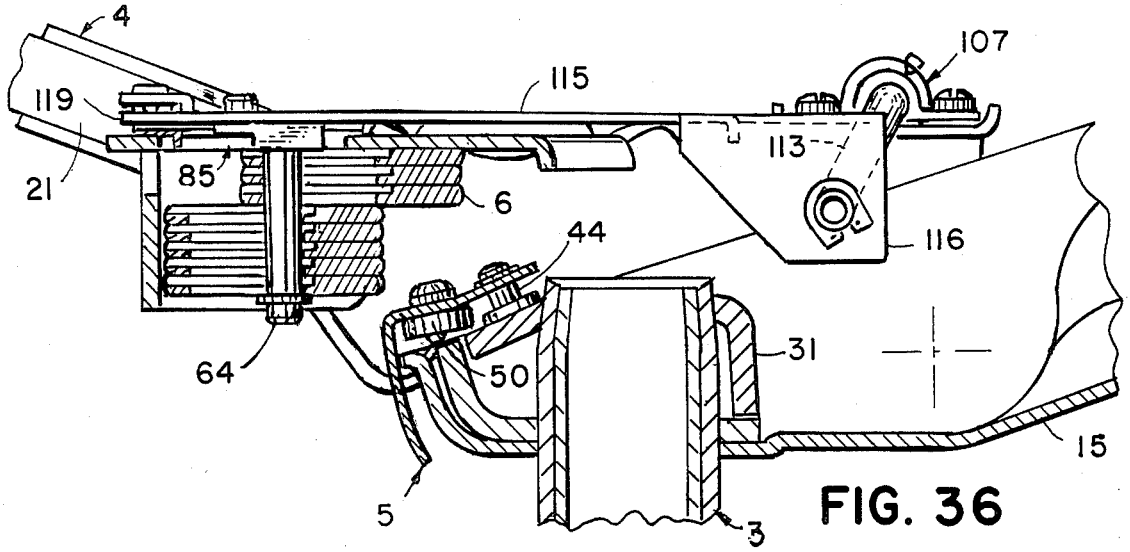
FIG. 36 is a vertical cross-sectional view of the variable back stop, shown with the stop plates shifted in the position illustrated in FIGS. 35 and 36, and with the chair back tilted forwardly to the fully upright position.
Figure 37:
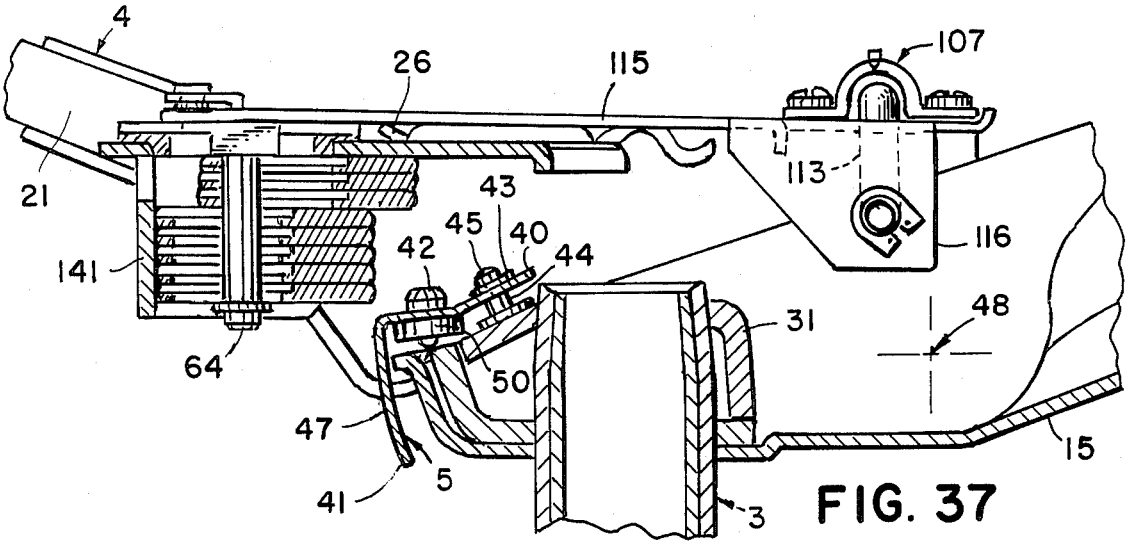
FIG. 37 is a vertical cross-sectional view of the variable back stop, with the stop plates shifted one-half of the way between the engaged and disengaged positions.

Stop bracket 5 (FIG. 2) comprises a rigid angular channel, with integrally formed upper and lower legs 40 and 41 respectively, and may be constructed of formed, sheet metal, or the like. Stop bracket 5 is attached to control housing 15 along the rear edge or lip of control housing 15. With reference to FIGS. 36 and 37, the upper leg 40 of stop bracket 5 includes an upper abutment surface or stop surface 42, and an upwardly inclined mounting lip 43 disposed forwardly thereof. Mounting studs 44 are fixedly attached to the cross brace portion 31 of control housing 15, and extend generally upwardly therefrom. The upper ends 45 of studs 44 are loosely or slidingly received in associated mounting apertures 46 (FIG. 2) on the mounting lip portion 43 of stop the forward portion of bracket 5. Studs 44 support the forward portion of stop bracket 5 on control housing brace 31, with stop bracket 5 spaced vertically above control housing 15 a predetermined distance for purposes to be described below. Stop surface 42 is inclined upwardly and forwardly at an angle of approximately 5 to 10 degrees to facilitate mating contact with the stop plates 6 in the manner described in greater detail hereinafter.

The lower leg 41 of stop bracket 5 extends generally downwardly from stop surface 42, and includes a rearwardly facing, exterior deflection surface 47. Deflection surface 47 is adapted to abuttingly engage selected stop plates 6 in the manner discussed below, and is generally arcuate in shape, with the center of the arc located generally coincident with the back pivot axis 48 of chair back 4, which is defined by bearing assembly 16. Deflection surface 47 has a length that is slightly greater than the height of stop plates 6.

A pair of cushions or stop buttons 50 are mounted on the lower side of stop surface 42, and support the rearward portion of stop bracket 5 on control housing 15. Stop buttons 50 are constructed of durable, resilient material, and abut mating portions of control housing 15, such as weldment area 49. Stop buttons 50 provide a smooth, cushioned stopping action for the rearward tilting action of chair back 4.

A second set of stop buttons 53 (FIG. 2) are mounted on the rear edge of control housing 15, and are positioned laterally outwardly from stop bracket 5. Stop buttons 53 are arranged in a conventional fashion, and selectively abut associated portions of said chair 2 to limit back tilt between a fully upright position, and a fully rearwardly tilted position.

A stop plate support surface 51 (FIGS. 32–34) is formed on the lower surface of cross stretcher 26, and is oriented substantially horizontally when chair 2 is in the fully upright position. Stop plate support surface 51 moves with chair back 4 as it tilts rearwardly, and therefore rotates about back pivot axis 48. Stop plate support surface 51 is substantially planar, such that stop plates 6 selectively slide thereover, and is vertically aligned with the bracket stop surface 42. The space between surfaces 42 and 51 defines a stop gap 52, which lies in the path of motion between cross stretcher 26 and stop bracket 5. In the illustrated example, the path of motion between surfaces 42 and 51 is generally arcuate, as noted by the arrow in FIG. 32, with its center concentric with back pivot axis 48. However, it is to be understood that the present invention also contemplates different paths of motion between the converging surfaces 42 and 51.

Figure 28:
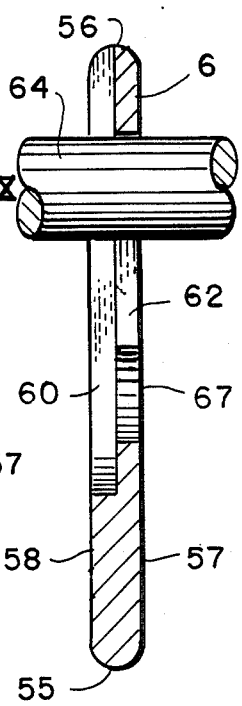
FIG. 28 is a vertical cross-sectional view of the stop plate, taken along the line XXVIII—XXVIII of FIG. 27.
Figure 29:
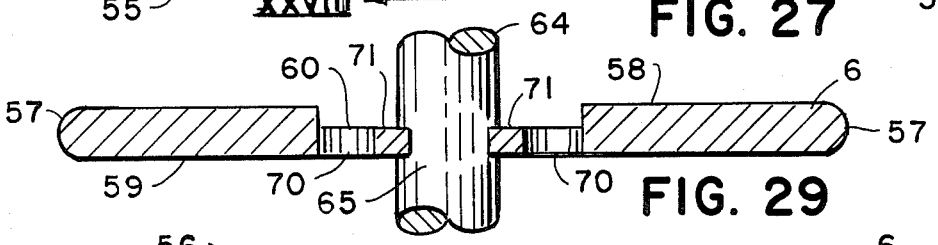
FIG. 29 is a vertical cross-sectional view of the stop plate, taken along the line XXIX—XXIX of FIG. 27.
Figure 30:
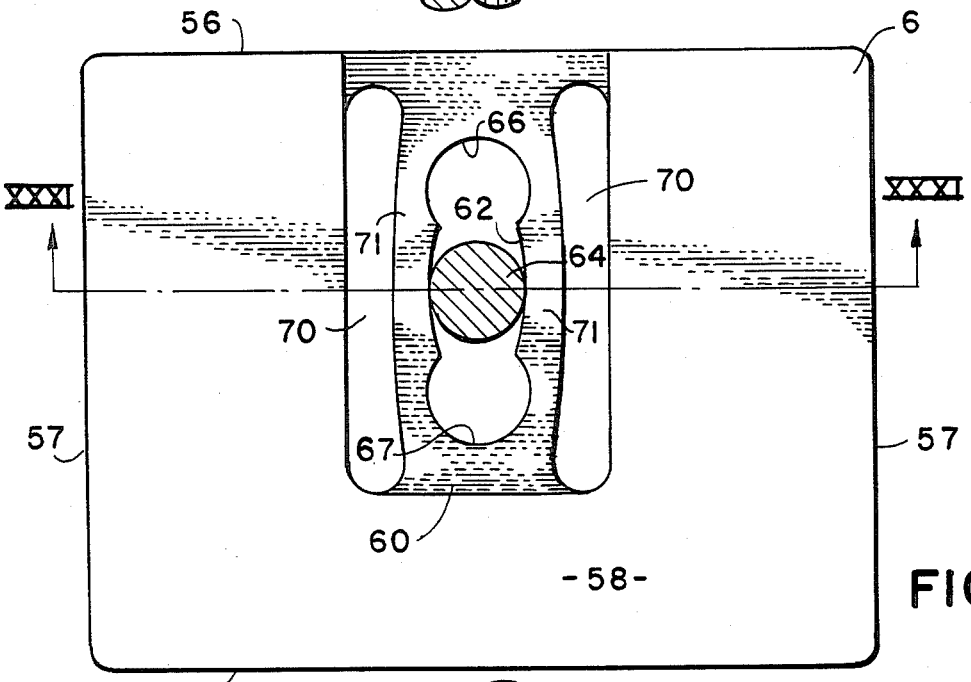
FIG. 30 is a top plan view of the stop plate, with the control pin shown in an intermediate position.

The illustrated variable back stop 1 has a plurality of stop plates 6 positioned on top of one another in a stack oriented generally perpendicular to the path of motion between cross stretcher 26 and stop bracket 5. In this example, stop plates 6 are arranged in a vertically stacked relationship. As best illustrated in FIGS. 27–31, stop plates 6 are substantially identical, and each is basically planar, and has a generally rectangular plan configuration, with a front edge 55, a rear edge 56, opposite side edges 57, an upper surface 58 and a lower surface 59. Stop plates 6 are preferably constructed from an antifriction material, such as a nylon, or the like, and the rear and side edges 56 and 57 are rounded, with the front edge 55 substantially square. Stop plates 6 have a centrally disposed, recessed area 60 in the upper surface 58 thereof, which extends from a forward portion of stop plate 6, all the way through the rear edge 56 of stop plate 6. As best illustrated in FIGS. 29 and 30, recess 60 extends downwardly through approximately one-half of the thickness of stop plate 6, and has a substantially rectangular top plan shape. An elongate aperture or control slot 61 extends vertically downwardly through each stop plate 6 from recess 60 along the transverse axis of the stop plate. The central slot 61 is defined by opposite sidewalls 62 and 63, which are oriented in a direction generally transverse to the path of motion between stop surfaces 41 and 51. Recess 60 serves to assist in making slot sidewalls 62 and 63 laterally flexible, as discussed below.

Figure 31:
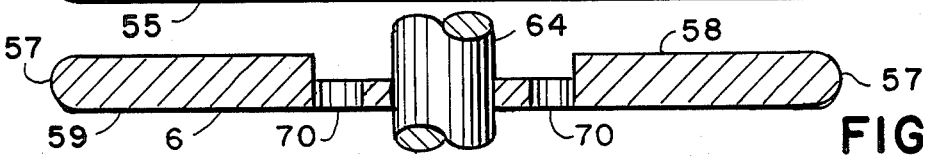
FIG. 31 is a vertical cross-sectional view of the stop plate, taken along the line XXXI—XXXI of FIG. 30.

A control pin 64 is received vertically in the slots 61, and defines at least a portion of the mechanism which shifts stop plates 6 between the engaged and disengaged positions. In the illustrated example, control pin 64 has a generally circular transverse cross-sectional shape, with a relatively smooth outer surface 65. Central slots 61 include enlarged, arcuate ends 66 and 67, which open into the rectangular, medial portion of the associated central slot 61. The enlarged ends 66 and 67 of central slots 61 are sized slightly larger than the diameter of control pin 64, as shown in FIG. 28, to closely receive the same therein with a snapping action. The distance between the sidewalls 62 and 63 of central slots 61 at the medial portion thereof is slightly less than the outside diameter of control pin 64, so as to provide frictional contact therebetween, as shown in FIGS. 30 and 31.

Each stop plate 6 also includes a pair of elongate apertures or side slots 70 (FIGS. 27–31), which extend vertically therethrough and are positioned on opposite sides of the associated central slot 61. Side slots 70 extend slightly forwardly and rearwardly of central slot 61, and define relatively thin rib portions 71 of stop plate 6, disposed between side slots 70 and central slot 61. The rib portions 71 of stop plate 6 are resiliently flexible or deformable in a transverse direction by contact with the outer surface 65 of control pin 64 to provide a controlled frictional contact therebetween for purposes of shifting stop plate 6 between the engaged and disengaged positions. In the illustrated example, variable back stop 1 includes eight separate stop plates 6.

Figure 22:
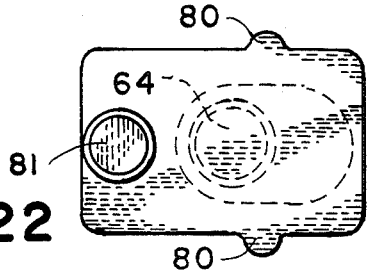
FIG. 22 is a top plan view of the control pin.
Figure 20:
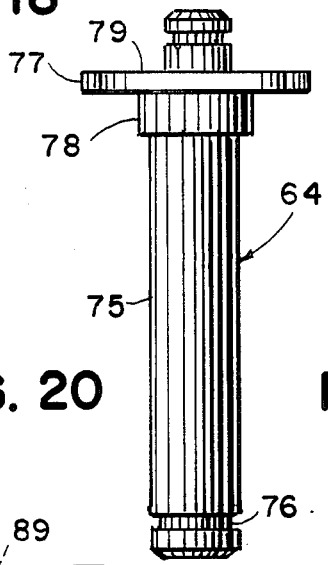
FIG. 20 is a front elevational view of a control pin portion of the stop plate assembly.
Figure 21:
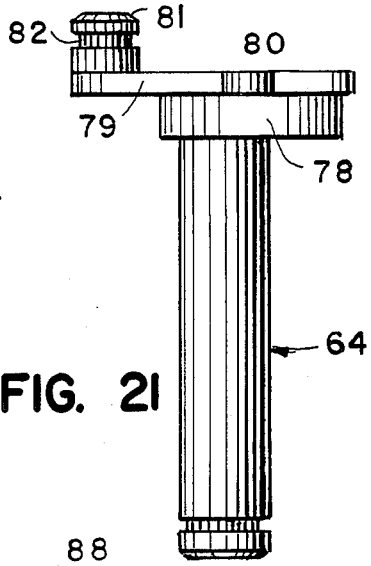
FIG. 21 is a side elevational view of the control pin.
Figure 23:
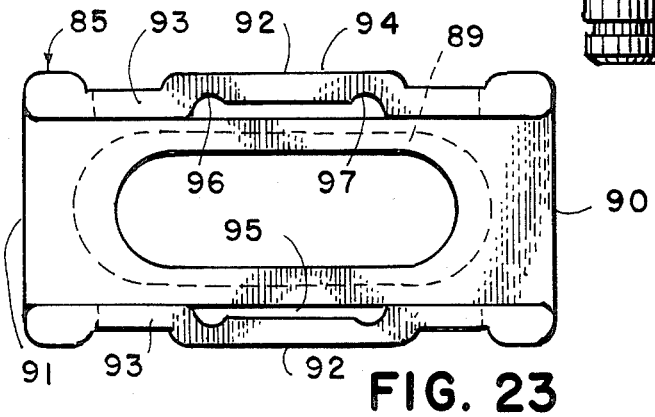
FIG. 23 is a top plan view of a pin bearing portion of the stop plate assembly.
Figure 24:
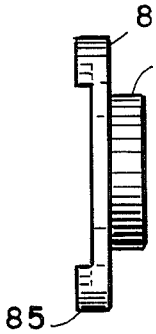
FIG. 24 is a side elevational view of the pin bearing.
Figure 25:
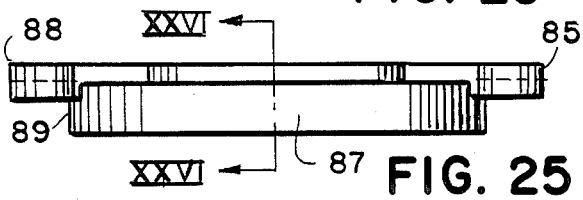
FIG. 25 is a front elevational view of the pin bearing.
Figure 26:
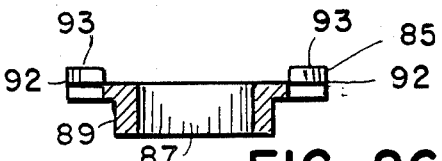
FIG. 26 is a vertical cross-sectional view of the pin bearing, taken the line XXVI—XXVI of FIG. 25.
Figure 27:
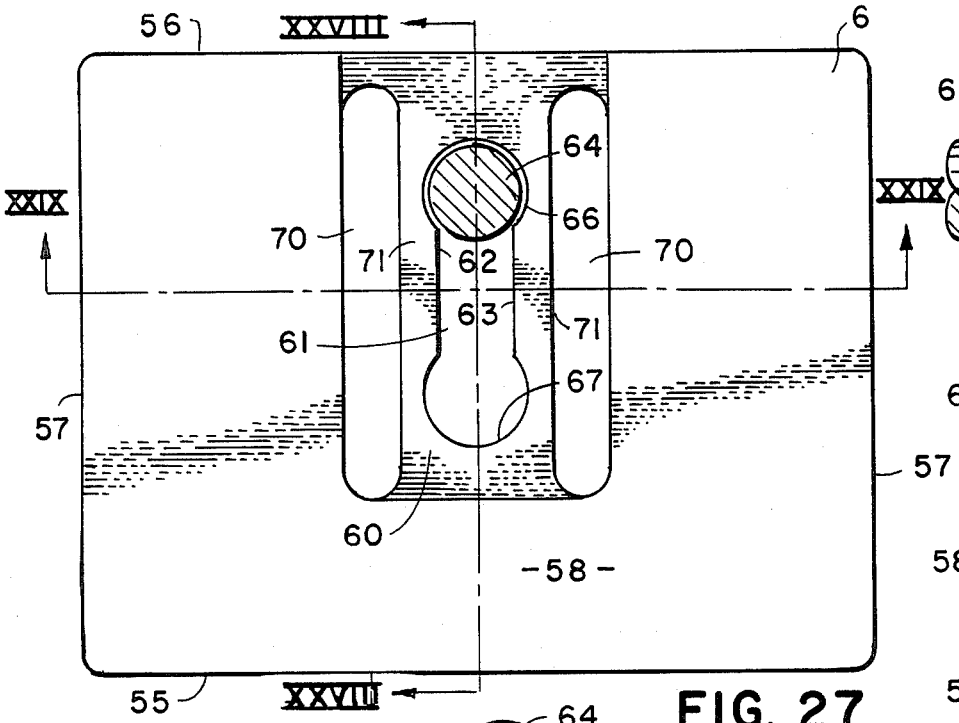
FIG. 27 is an enlarged, top plan view of a stop plate portion of the stop plate assembly, wherein the control pin is shown in a released position.

With reference to FIGS. 20–22, control pin 64 has a cylindrical body 75 with a retainer groove 76 at the lower end thereof, and an enlarged head 77 at the upper end thereof. Control pin head 77 includes an oblong guide portion 78, and an upper plate 79 with transversely protruding ears 80. A connector spindle 81 is attached to one end of plate 79, and extends upwardly therefrom to a retainer groove 82 for the purpose described below.

A mating pin bearing 85 (FIGS. 23–26) is provided to slidably mount control pin 64 in cross stretcher 26. As best illustrated in FIG. 2, cross stretcher 26 has a generally T-shaped plan configuration, wherein the central, rearwardly protruding portion 86 of cross stretcher 26 includes an elongated aperture 87 oriented in a fore-to-aft direction. Pin bearing 85 is shaped to be closely received in the aperture 87 on the central portion 86 of cross stretcher 26, and includes an upper plate portion 88 (FIGS. 23–26), and an integral collar portion 89 protruding downwardly therefrom. Bearing collar 89 has an oblong shape, which is substantially commensurate in shape with cross stretcher aperture 87, and is closely received therein. The upper plate portion 88 of pin bearing 85 has a substantially rectangular plan configuration, and includes front edge 90, rear edge 91, and opposite side edges 92. A pair of rails 93 extend along the side edges 92 of pin bearing 85, and project upwardly from the upper surface of plate 88. The center portions 94 of rails 93 are shaped apart from plate 88 by slots or openings 95, and include two pairs of longitudinally spaced apart detents 96 and 97, which are shaped to selectively receive the ears 80 of control pin 64 therein. When assembled, control pin 64 is inserted vertically downwardly through the cylindrical body portion 75 of collar 89. The side edges of control pin plate 79 are received between the side rails 93 of pin bearing 85, and the guide portion 78 of control pin 64 is received within the interior of pin bearing collar 89. The ears 80 on control pin 64 are located between the center portions 94 of rails 93, and translate longitudinally between detents 96 and 97. Control pin 64 is permitted to slide in a fore-to-aft direction within pin bearing 85. As described in greater detail hereinafter, when control pin ears 80 are positioned in the rearward rail detents 94, variable back stop 1 is in the "off" position, and when control pin ears 80 are disposed in the forward set of rail detents 95, variable back stop 1 is in the "on" position.

Actuator 7 (FIGS. 5–7), in conjunction with a control arm assembly 100, translates control pin 64 in a fore-to-aft direction from a seated position within chair 2. In the illustrated example, actuator 7 comprises a toggle button 101 which is rotatably mounted in the bottom cover or shell 30 of chair 2 at a position that can be easily reached by the hand of an adult user seated in a comfortably upright position in chair 2. Toggle button 101 is mounted in bottom shell 30 by a spring clip 99 (FIG. 1) for rotation about a substantially horizontally oriented axis, and includes an outwardly protruding knob portion 102 (FIGS. 5–7), which shifts in a fore-to-aft direction between the "on" and "off" positions. A laterally extending arm 103 is formed integrally with toggle button 101, and includes a joint member 104 at the inward end thereof.

As best illustrated in FIGS. 5–10, control arm assembly 100 includes a lever arm 106, which is rotatably mounted on the left-hand rear stretcher 21 by a pivot block assembly 107, comprising a base 108, bearing shims 109, and a bearing cap 110 attached to base 108 by fasteners 111. Lever arm 106 includes a pivot joint 112 at its outer end, and an off-set bell crank 113 at its inner end. Lever arm 106 is oriented in a substantially transverse direction, and is retained in pivot block assembly 107 for rotation about a substantially horizontally oriented axis. Rotation of lever arm 106 causes bell crank 113 to rotate through a generally vertical plane, located along the longitudinal center line of control housing 15.

Figure 17:
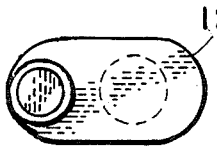
FIG. 17 is a top plan view of a pivot support portion of the stop plate assembly.
Figure 18:
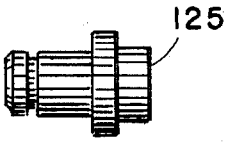
FIG. 18 is a side elevational view of the pivot support.
Figure 19:
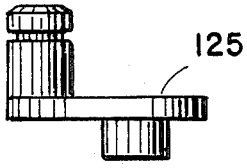
FIG. 19 is a front elevational view of the pivot support.

With reference to FIGS. 7–10, control arm assembly 100 also includes a control arm 115, having a forward end 116 attached to bell crank 113, a medial portion 117 extending rearwardly therefrom over cross stretcher 26, and a rearward end 118 connected with a pivot link 119. The right-hand end 120 (FIG. 10) of pivot link 119 is pivotally attached to the upstanding fastener spindle 81 on control pin 64. A retainer 121 is mounted on fastener spindle 81 to rotatably interconnect pivot link 119 with control pin 64. The left-hand end 122 of pivot link 119 includes an upstanding fastener spindle 123 which extends through a mating aperture on the rearward end 118 of control arm 115. A retainer 124 rotatably interconnects pivot link 119 with control arm 118. A pivot joint 125 (FIGS. 17–19) rotatably connects the center portion of pivot link 119 with the central leg 86 of cross stretcher 26, thereby permitting the left-hand and right-hand ends 120 and 122 of pivot link 119 to pivot or rock slightly in a vertical plane. This rocking motion is required to insure proper alignment between the various linkage portions of control arm assembly 100, as chair back 4 is tilted.

With reference to FIGS. 5–7, an adjustable universal joint assembly 130 connects the outer end of lever arm 106 with the inner end 104 of toggle button 101. Universal joint assembly 130 includes two telescoping members 131 and 132, which slide longitudinally with respect to one another. The inner U-joint member 131 has a ball end 133 that is received in the pivot joint 112 of bell crank 113. The outer U-joint member 132 also has a ball-shaped end 134 which is received matingly in the pivot joint 104 of toggle arm 103. Both ends 133 and 134 of U-joint assembly 130 include laterally oriented apertures therethrough in which pins 135 are received to transmit rotational motion from toggle button 101 to bell crank 113.

As best illustrated in FIGS. 3 and 4, variable back stop 1 also includes a stop plate housing 140 mounted on the lower surface of the central portion 87 of cross stretcher 26. Housing 140 includes rear wall 141 and opposite sidewalls 142, which are spaced so as to receive stop plates 6 therebetween. The forward side of stop plate housing 140 is open, thereby permitting stop plates 6 to extend into the path of motion between stop surfaces 42 and 51. The rear and sidewalls 141 and 142 of housing 140 extend downwardly a distance slightly beyond the lowest stop plate 6, and are generally parallel with the central axis of control pin 64. The rear wall 141 of housing 140 provides a surface against which stop plates 6 abut when toggle button 101 is moved to the "off" position, as described in greater detail hereinafter.

Figure 32:
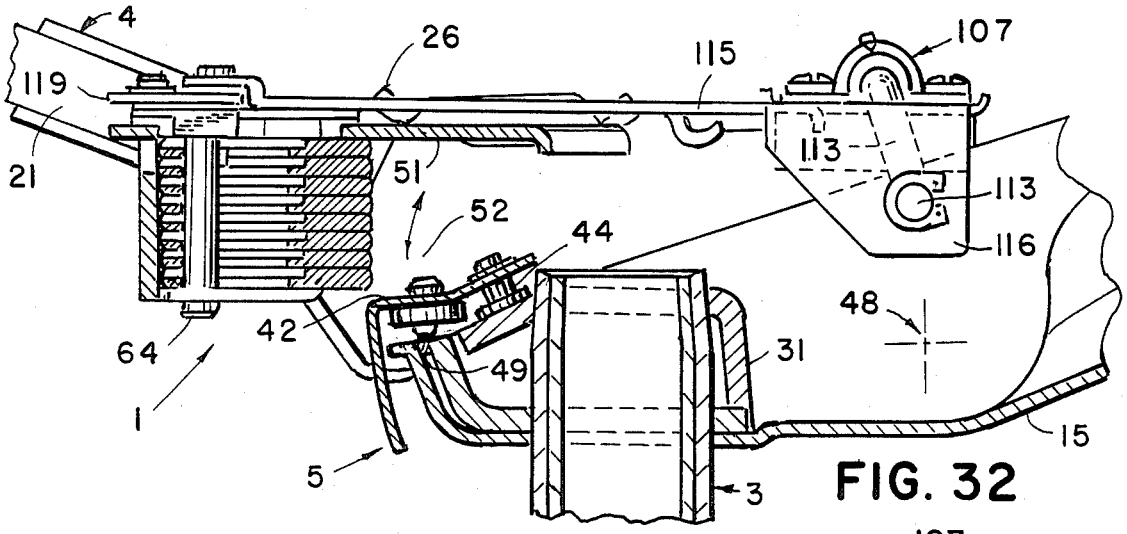
FIG. 32 is a vertical cross-sectional view of the variable back stop, shown with the stop plates in the disengaged position, and the chair back in a fully upright position.
Figure 33:
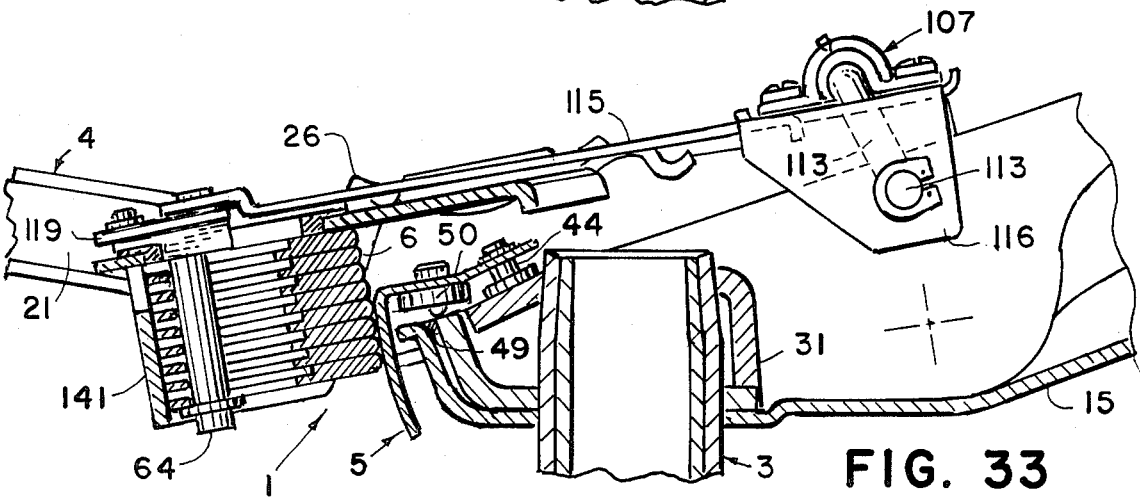
FIG. 33 is a vertical cross-sectional view of the variable back stop, shown with the stop plates in the disengaged position, and the chair back in a rearwardly tilted position.

With reference to FIGS. 32–37, in use, variable back stop 1 operates in the following fashion. With chair back 4 in the fully upright position, and toggle button 101 in the "off" position, as illustrated in FIG. 32, all of the stop plates 6 are generally aligned with the stop gap 52. To limit or prevent chair back 4 from tilting rearwardly beyond a selected position, which is less than the fully rearwardly tilted position of chair back 4, the user simply tilts chair back 4 rearwardly to the desired position, such as the position illustrated in FIG. 34. The user then reaches downwardly along the left-hand side of chair 2, grasps the knob portion 102 of toggle button 101, and shifts the same forwardly to the "on" position. Toggle button 101 shifts between the "on" and "off" positions with a snapping action which prevents the same from assuming an intermediate or partially "on" or partially "off" position. This rotation of toggle button 101 is transmitted through control arm assembly 115, and shifts control pin 64 forwardly from the release position to the stop position. Due to the abutting engagement between control pin 64 and the walls forming the enlarged portions 66 of central stop plate slots 61, those stop plates 6 which are aligned with the stop gap 52 move with control pin 64 into the engaged position. Those stop plates 6 that are not aligned with the stop gap 52 engage the deflection surface 47 of stop bracket 5, which engagement causes such stop plates 6 to remain in the disengaged position, outside of stop gap 52. Since control pin 64 continues to move forwardly to the stop position, control pin 64 is pulled through or along the central slots 61 of the disengaged stop plates 6.

Figure 34:
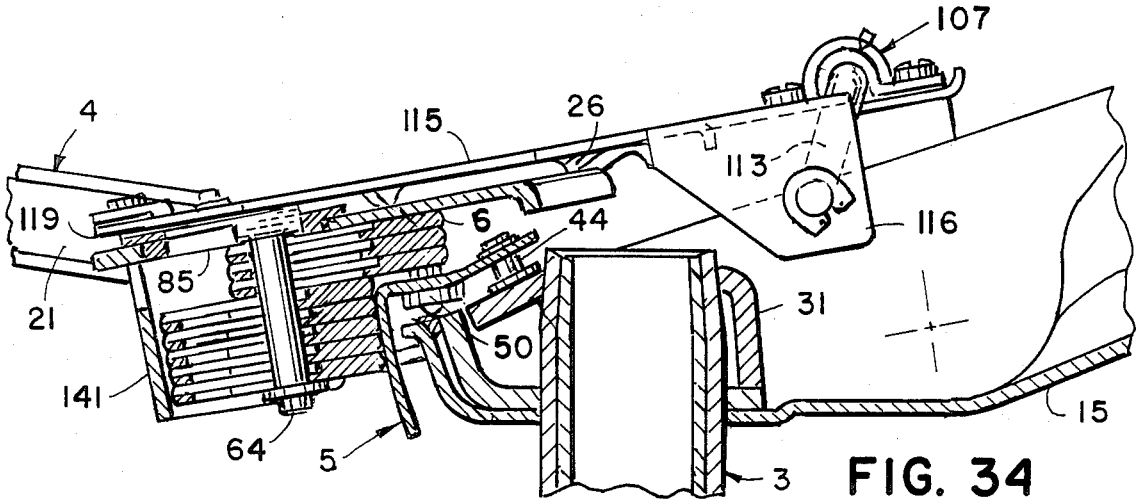
FIG. 34 is a vertical cross-sectional view of the variable back stop, shown with the chair back in the rearwardly tilted position illustrated in FIG. 34, and with the three uppermost stop plates shifted into the engaged position.

In the example illustrated in FIGS. 32–37, the top three stop plates 6 are aligned with stop gap 52 in the rearwardly tilted position selected by the user. Hence, the top three stop plates 6 move with control pin 64 into the engaged position. The forward edges 55 of the lower five stop plates 6 engage the deflection surface 47 of stop bracket 5. Upon such engagement, control pin 64 moves out of the rearward, enlarged ends 66 of central slots 61 in the lower five stop plates 6, through the central portion thereof deforming ribs 71 laterally, and then snaps into the forward enlarged ends of the central slots, as best shown in FIG. 34.

In the event that only a portion of one of the stop plates 6 engages deflection surface 47, as is the case in the stop plate 6 located fourth from the top in FIG. 34, a slight gap will exist between those stop plates 6 in the engaged position, and the stop surface 42 of stop bracket 5. Hence, some slight additional rearward tilting of chair back 4 is required before the lowermost one of the three stop plates 6 in the engaged position abuts the stop surface 42 of stop bracket 5. Any further rearward tilting of chair back 4 pivots stop bracket 5 slightly downwardly about studs 44, and compresses stop buttons 50 between stop bracket 5 and the adjacent portions of control housing 15 to gently yet positively stop any further rearward tilting of chair back 4, as shown in FIG. 35.

Figure 35:
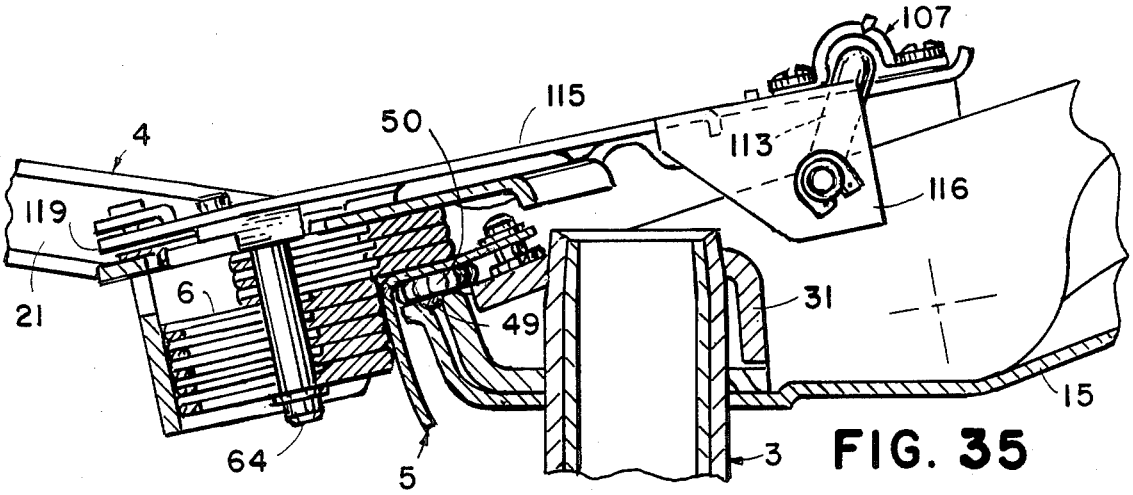
FIG. 35 is a vertical cross-sectional view of the variable back control, with the stop plates shifted in the position illustrated in FIG. 35, and with the chair back tilted slightly rearwardly further into an intermediate tilt position.

When chair back 4 is again tilted rearwardly, the lowermost one of the engaged stop plates 6 abuts the stop surface 42 of stop bracket 5, and pushes downwardly on the stop bracket to compress stop buttons 50 between stop brackets 5 and the mating surface of control housing 15, as shown in FIG. 35. This engagement positively prevents further rearward tilting of chair back 4. Chair back 4 will not tilt any further rearwardly, until variable back stop 1 is readjusted in the following fashion.

To readjust variable back stop 1, the user shifts chair back 4 slightly forwardly to relieve the downward pressure on stop plates 6. Alternatively, the user may choose to simply return chair back 4 to its fully upright position, as shown in FIG. 36. In either case, the user then shifts toggle button 101 rearwardly to the "off" position. The rotation of toggle button 101 to the "off" position is transmitted through control arm assembly 101 to control pin 64, and translate the same rearwardly from the stop position to the release position. With reference to FIG. 37, as control pin 64 moves rearwardly to the release position, the rearward edges 56 of all of the stop plates 6 engage the rear wall 141 of housing 140, thereby restraining the stop plates against further rearward translation. Continued motion of control pin 64 draws the control pin from the forward enlarged end 67 of central slots 61, along the medial portions thereof, and snaps into the rearward enlarged ends 66 of central slots 61. Hence, when control pin 64 reaches the release position, all of the stop plates 6 are vertically aligned in the disengaged position, with their rearward edges 56 abutting the rear wall 141 of stop plate housing 140.

Variable back stop 1 provides a mechanical, positive type of stopping action that is extremely reliable. The multiple, vertically stacked stop plates 6 permit the rearward tilting of chair back 4 to be limited or restricted to a variety of different positions to accommodate all types of users and tasks. Variable back stop 1 can be easily manipulated by a seated user, such that the desired tilt stop position of chair back 11 can be set, quickly tested, and easily readjusted if necessary to obtain maximum comfort.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a chair of the type having a stationary support and a back which tilts with respect to said support, the improvement of a variable back stop comprising:

a stop surface disposed on one of said chair support and said chair back;

a plurality of stop members positioned on top of one another in a stack, and operably connected with the other of said chair support and said chair back; said stop surface and said stop members being mutually positioned such that rearward tilting of said chair back generally converges said stop surface and said stop members along a path of motion, and forward tilting of said chair back generally diverges said stop surface and said stop members; said stop members having an engaged position wherein at least a portion of one of said stop members is positioned in said path of motion to abut said stop surface upon rearward tilting of said chair back, and a disengaged position wherein said stop members are positioned outside of said path of motion to avoid abutting said stop surface upon rearward tilting of said chair back;

means for interconnecting said stop members and selectively shifting groups of adjacently disposed stop members between the engaged and disengaged positions to limit rearward tilting of said chair back at a plurality of different positions.

2. A chair as set forth in claim 1, wherein:

said stop member shifting means includes an actuator mounted on said chair at a location accessible by a seated user to permit manipulation of said variable back stop from a seated position in said chair.

3. A chair as set forth in claim 2, wherein:

said stop members comprise stop plates operably connected with said chair back.

4. A chair as set forth in claim 3, wherein:

said stop surface is disposed on a stop bracket operably connected with said chair support.

5. A chair as set forth in claim 4, including:

means for limiting rearward tilting of said chair back at a fully rearwardly tilted position.

6. A chair as set forth in claim 5, including:

a stop plate support surface located on said chair back in said path of motion, and on which said stop plates are slidingly supported; said stop plate support surface and said stop surface defining a stop gap therebetween along said path of motion; and wherein at least portions of said stop plates are disposed in said stop gap when in the engaged position to define associated intermediate rearwardly tilted positions of said chair back.

7. A chair as set forth in claim 6, wherein said stop plate interconnecting means comprises:

a control pin positioned to frictionally engage associated portions of said stop plates to normally cause said stop plates to move with said control pin, yet permit selective sliding movement therebetween.

8. A chair as set forth in claim 7, wherein said stop plate interconnecting means further comprises:

elongate apertures extending through said stop plates, and being defined by side edges oriented in a direction generally transverse to said path of motion; and wherein said control pin is received in said stop plate apertures, and has a marginal surface thereof frictionally engaging the side edges of said stop plate apertures to normally cause said stop plates to move with said control pin, yet permit selective sliding movement therebetween.

9. A chair as set forth in claim 8, wherein:

said stop bracket includes a deflector surface disposed generally parallel with said path of motion, and located laterally between said stop surface and said stop plates in the disengaged position; and means for shifting said control pin in a direction generally transverse to said path of motion between a stop position and a release position, whereby when said chair back is in a selected, rearwardly tilted position, shifting said control pin to the stop position causes those stop plates aligned with said stop gap to shift into the engaged position within said stop gap, and those stop plates not aligned with said stop gap to engage the deflection surface of said stop bracket and remain in the disengaged position, such that until said variable back stop is readjusted, said chair back will not tilt rearwardly beyond said selected position.

10. A chair as set forth in claim 9, including:

a stop plate housing connected with said chair back, and including a rear wall oriented generally parallel with said control pin, and positioned to align said stop plates in the disengaged position, whereby shifting said control pin to the release position causes all of said stop plates to move rearwardly with said control pin until said stop plates abut the rear wall of said stop plate housing, thereby vertically aligning said stop plates in the disengaged position.

11. A chair as set forth in claim 10, wherein:

said actuator has an "on" position and an "off" position; and said control pin shifter means includes a control arm assembly connecting said actuator with said control pin in a manner such that when said actuator is in the "on" position, said control pin shifting means is in the stop position, and when said actuator is in the "off" position, said control pin shifting means is in the release position.

12. A chair as set forth in claim 11, wherein:

said actuator comprises a toggle button.

13. A chair as set forth in claim 12, wherein:

said control arm assembly includes means for shifting said control pin shifting means directly between said stop and said release positions, without any intermediate positions, in response to movement of said toggle button between the "on" and "off" positions.

14. A chair as set forth in claim 13, wherein:

said stop plate apertures include enlarged portions at opposite ends thereof shaped generally commensurately with said control pin for close reception therein.

15. A chair as set forth in claim 14, wherein:

said stop plates each include a pair of slots oriented parallel with said elongate aperture on opposite sides thereof to define opposite rib portions of said stop plates located between the side edges of said elongate apertures and said slots; said ribs being resiliently deformable in a transverse direction by contact with said control pin to define at least a portion of said stop plate shifting means.

16. A chair as set forth in claim 15, including:
mounting posts having lower ends thereof connected with said chair support, and upper ends thereof connected with said stop bracket to position said stop bracket a spaced apart distance above said chair housing.

17. A chair as set forth in claim 16, including:
a resilient cushion positioned between said stop bracket and said chair housing.

18. A chair as set forth in claim 1, wherein:
said means for shifting said stop members includes an actuator mounted on said chair at a location accessible by a seated user to permit manipulation of said variable back stop from a seated position in said chair.

19. A chair as set forth in claim 1, wherein:
said stop surface is disposed on said chair support; and
said stop member is operably connected with said chair back.

20. A chair as set forth in claim 1, wherein:
said stop members comprise a plurality of stop plates positioned on top of one another in a stack oriented generally perpendicular to said path of motion; and including
a stop plate support surface located on said chair back in said path of motion, and on which said stop plates are slidingly supported; said stop plate support surface and said stop surface defining a stop gap therebetween along said path of motion; and wherein
at least portion of said stop plates are disposed in said stop gap when in the engaged position to define an associated intermediate rearwardly tilted position of said chair back.

21. A chair as set forth in claim 20, including:
a control pin positioned to frictionally engage associated portions of said stop plates to normally cause said stop plates to move with said control pin, yet permit selective sliding movement therebetween.

22. A chair as set forth in claim 21, including:
a deflector surface disposed generally parallel with said path of motion, and located laterally between said stop surface and said stop plates in the disengaged position; and
means for shifting said control pin in a direction generally transverse to said path of motion between a stop position and a release position, whereby when said chair back is in a selected, rearwardly tilted position, shifting said control pin to the stop position causes those stop plates aligned with said stop gap to shift into the engaged position within said stop gap, and those stop plates not aligned with said stop gap to engage the deflection surface of said stop bracket and remain in the disengaged position, such that until said variable back stop is readjusted, said chair back will not tilt rearwardly beyond said selected position.

23. A chair as set forth in claim 22, including:
a stop plate housing connected with said chair back, and including a rear wall oriented generally parallel with said control pin, and positioned to align said stop plates in the disengaged position, whereby shifting said control pin to the release position causes all of said stop plates to move rearwardly with said control pin until said stop plates abut the rear wall of said stop plate housing, thereby vertically aligning said stop plates in the disengaged position.

24. A chair as set forth in claim 1, including:
a stop bracket on which said stop surface is disposed; and
mounting posts having lower ends thereof connected with said chair support, and upper ends thereof connected with said stop bracket to support said stop bracket a spaced apart distance above said chair housing.

25. A chair as set forth in claim 24, including:
a resilient cushion positioned between said stop bracket and said chair housing.

26. A variable back stop for tilt back chairs and the like of the type having a stationary support and a back which tilts with respect to said support; said variable back stop comprising:
a stop bracket adapted for connection with one of the chair support and the chair back;
a plurality of stop plates arranged in a stack, and adapted for connection with the other of the chair support and the chair back;
means for positioning said stop bracket and said stop plates in a predetermined spatial relationship, such that rearward tilting of the chair back generally converges said stop bracket and said stop plates along a path of motion, and forward tilting of the chair back generally diverges said stop bracket and said stop plates; said stop plates having an engaged position wherein at least a portion of one of said stop plates is positioned in said path of motion to abut said stop bracket upon rearward tilting of said chair back, and a disengaged position wherein said stop plates are positioned outside of said path of motion to avoid abutting said stop bracket upon rearward tilting of said chair back;
means for interconnecting said stop plates and selectively shifting groups of adjacently disposed stop plates between the engaged and disengaged positions to limit rearward tilting of said chair back at a plurality of different positions.

27. A variable back stop as set forth in claim 26, wherein:
said stop plate shifting means includes an actuator adapted to be mounted on the chair at a location accessible by a seated user to permit manipulation of said variable back stop from a seated position in the chair.

28. A variable back stop as set forth in claim 27, wherein said stop plate interconnecting means comprises:
elongate apertures extending through said stop plates, and being defined by side edges oriented in a direction generally transverse to said path of motion; and
a control pin received in said stop plate apertures, and having a marginal surface thereof frictionally engaging the side edges of said stop plate apertures to normally cause said stop plates to move with said control pin, yet permit selective sliding movement therebetween.

29. A variable back stop as set forth in claim 28, wherein:
said stop bracket includes an abutment surface disposed in said path of motion, and a deflector surface disposed generally parallel with said path of motion, and located laterally between said abutment surface and said stop plates in the disengaged position; and means for shifting said control pin in a direction generally transverse to said path of motion between a stop position and a release position, whereby when the chair back is in a selected, rearwardly tilted position, shifting said control pin to the stop position causes those stop plates aligned with said stop gap to shift into the engaged position within said stop gap, and those stop plates not aligned with said stop gap to engage the deflection surface of said stop bracket and remain in the disengaged position, such that until said variable back stop is readjusted, the chair back will not tilt rearwardly beyond the selected position.

30. A variable back stop as set forth in claim 29, including:

a stop plate housing adapted for connection with the chair back, and including a rear wall oriented generally parallel with said control pin, and positioned to align said stop plates in the disengaged position, whereby shifting said control pin to the release position causes all of said stop plates to move rearwardly with said control pin until said stop plates abut the rear wall of said stop plate housing, thereby vertically aligning said stop plates in the disengaged position.

31. A variable back stop as set forth in claim 30, wherein:

said actuator comprises a toggle button having an "on" position and an "off" position; and said control pin shifter means comprises a control arm assembly connecting said toggle button with said control pin in a manner such that when said toggle button is in the "on" position, said control pin shifting means is in the stop position, and when said toggle button is in the "off" position, said control pin shifting means is in the release position.

32. A variable back stop as set forth in claim 31, wherein:

said control arm assembly includes means for shifting said control pin shifting means directly between said stop and said release positions, without any intermediate positions, in response to movement of said toggle button between the "on" and "off" positions.

33. A variable back stop as set forth in claim 32, wherein:

said stop plate apertures include enlarged portions at opposite ends thereof, shaped generally commensurately with said control pin for close reception therein.

34. A variable back stop as set forth in claim 33, wherein:

said stop plates each include a pair of slots oriented parallel with said elongate aperture on opposite sides thereof to define opposite rib portions of said stop plates located between the side edges of said elongate apertures and said slots; said ribs being resiliently deformable in a transverse direction by contact with said control pin to define at least a portion of said stop plate shifting means.

35. In furniture articles of the type having a first furniture portion and a second furniture portion which converge and diverge with respect to each other, the improvement of a variable stop comprising:

a stop surface disposed on said first furniture portion;

a plurality of stop members positioned on top of one another in a stack, and operably connected with said second furniture portion; said stop surface and said stop members being mutually positioned such that movement of said first and second furniture portions in one direction generally converges said stop surface and said stop members along a path of motion, and movement of said first and second furniture portions in an opposite direction generally diverges said stop surface and said stop members; said stop members having an engaged position wherein at least a portion of one of said stop members is positioned in said path of motion to abut said stop surface upon relative converging motion of said first and second furniture portions, and a disengaged position wherein said stop members are positioned outside of said path of motion to avoid abutting said stop surface upon relative converging motion of said first and second furniture portions;

means for interconnecting said stop members and selectively shifting groups of adjacently disposed stop members between the engaged and disengaged positions to limit relative motion of said first and second furniture portions at a plurality of different positions.

36. In a chair of the type having a stationary support, a seat, and a back which tilts with respect to said support and relative to said seat between a fully upright position and a fully rearwardly tilted position in response to movement by a seated user, the improvement of a variable back stop to selectively limit rearward tilting of said chair back at an intermediate position disposed between the fully upright position and the fully rearwardly tilted position, said variable back stop comprising:

a stop surface disposed on one of said chair support and said chair back;

at least one stop plate operably connected with the other of said chair support and said chair back; said stop surface and said stop plate being mutually positioned such that rearward tilting of said chair back generally converges said stop surface and said stop plate along a path of motion, and forward tilting of said chair back generally diverges said stop surface and said stop plate; said stop plate having an engaged position wherein at least a portion of said stop plate is positioned in said path of motion to abut said stop surface upon rearward tilting of said chair back, and a disengaged position wherein said stop plate is positioned outside of said path of motion to avoid abutting said stop surface upon rearward tilting of said chair back;

means for selectively shifting said stop plate along a plane that lies in a direction generally transverse to said path of motion between the engaged and disengaged positions to selectively limit rearward tilting of said chair back at the intermediate position.

* * * * *